US007824202B1

(12) United States Patent
Bria et al.

(10) Patent No.: US 7,824,202 B1
(45) Date of Patent: Nov. 2, 2010

(54) DENTAL LAMP WITH IMPROVED LAMP SOCKET

(75) Inventors: Joe Bria, Waxhaw, NC (US); Austin Unsworth, Fort Mill, SC (US)

(73) Assignee: Dental Equipment, LLC, Charlotte, NC (US)

( * ) Notice: Subject to any disclaimer, the term of this patent is extended or adjusted under 35 U.S.C. 154(b) by 0 days.

(21) Appl. No.: 12/766,987

(22) Filed: Apr. 26, 2010

(51) Int. Cl.
*H01R 33/02* (2006.01)

(52) U.S. Cl. ..... 439/234; 439/237; 439/232; 439/698

(58) Field of Classification Search ..... 439/232, 439/234, 237, 242, 243, 244, 698, 923
See application file for complete search history.

(56) References Cited

U.S. PATENT DOCUMENTS 3,116,098 A * 12/1963 Kulka ..... 439/237
3,353,140 A * 11/1967 Johnson ..... 439/237
3,685,003 A * 8/1972 Watt ..... 439/237
5,122,074 A * 6/1992 Maag et al. ..... 439/237

* cited by examiner

*Primary Examiner*—Tho D Ta
(74) *Attorney, Agent, or Firm*—Timothy H. Van Dyke; Beusse Wolter Sanks Mora & Maire

(57) ABSTRACT

Disclosed herein is a dental lamp socket assembly especially adapted for use with dental lamps. The dental lamp socket assembly is configured to dramatically increase the ease at which bulbs can be placed and/or replaced in and out of the socket assembly.

11 Claims, 4 Drawing Sheets

DENTAL LAMP WITH IMPROVED LAMP SOCKET

FIELD OF INVENTION

The inventions of the this application relate to the field of electric lamps for generating light for illuminating dental work areas, and in particular, to a socket assembly especially adapted for use in dental lamps. The socket assembly releasably holds a light bulb, such as a halogen bulb, and is constructed to enable the easy replacement of the bulb that minimizes manual handling of the bulb surface, and possible risk of damage to the bulb or even potential injury to personnel replacing the bulb.

BACKGROUND

Halogen bulb lamps are an efficient light source, and are prevalent in lamps used in many industries including the dental industry. A typical halogen lamp assembly includes two socket terminals that are spring loaded to engage, hold and provide electrical contact with the bulbs. These terminal connections must be compressed to create space for positioning the halogen bulb into the lamp socket terminal and then released when the bulb is in place. Due to the high intense heat and light radiation, it is important that the surface of the halogen bulb not be contaminated with oils and moisture from the hands of the operator during placement. The presence of such contaminants can result in premature bulb failure, or even worse, bulb rupture. In an effort to avoid this problem, measures have been devised to minimize transfer of undesired contaminants. For example, operators may wear gloves during the placement of bulbs. However, gloves also pass on certain undesired residues to the bulb surface, but cause the loss of tactile feel and control thereby making the installation process more difficult.

Another issue that is involved in replacing halogen bulbs involves the spring loading of the socket terminals themselves. Due to the nature of socket terminal construction, the opening of the light socket terminal is cumbersome, as it requires three separate but simultaneous motions: the compression of the first socket terminal, the compression of the second socket terminal, and the placement of a new halogen bulb. Inserting the halogen bulb is difficult for one person limited to accomplish these three motions. The level of difficulty is only increased when the additional factor of avoiding contact with the bulb surface is factored into the routine. Another factor adding to the difficulty is the implementation of the forceful springs integrated in the socket assembly which must be pushed against via the fingers of the operator while the movements are performed.

SUMMARY

The inventors have recognized the problems and difficulties of replacing halogen bulbs in dental lamp assemblies and have developed a new dental lamp having a socket assembly that increases the ease of bulb replacement. Accordingly, a first embodiment of the present inventions pertain to a dental lamp that includes a dental lamp socket assembly having a housing with a first socket terminal and a second socket terminal movably mounted on the housing. In a specific embodiment, the first and second socket terminals each are associated with a socket base member that interact such that each socket terminal is movable with respect to the socket base member between an extended position and a retracted position. A spring associated with the socket base member urges the socket terminal into its extended position. The first socket terminal and second socket terminal have associated therewith a first and second manually operated actuator, respectively. Force applied to the actuator is transferred to the associated socket terminal to push the socket terminal into its retracted position whereby space is created for entry and positioning of the lamp bulb into the socket assembly. Moreover, the lamp socket assembly includes a first catch member that is associated with the socket terminal housing such that it releasably holds the first manually operated actuator in a retracted position. In an alternative embodiment, the socket assembly includes a second catch member that releasably holds a second manually operated actuator in its retracted position.

In using a typical embodiment of inventions of this application, force is applied to the first manually operated actuator which moves the first socket terminal into retracted position. In the retracted position, the catch member is moved to hold the manually operated actuator. While the first socket terminal is held in the retracted position by the first catch member, the operator's use of both hands is enabled to retract the second socket terminal by depressing the second manually operated actuator, and inserting a lamp bulb into the lamp socket terminal while both the first and second socket terminals are held in their retracted positions: the first socket terminal by the first catch member and the second socket terminal by the operator's hand. Once the lamp is in place, the second socket terminal is allowed to move toward its extended position, and the first socket terminal is released by the catch member to allow movement toward its extended position. Accordingly, the socket assembly equipped with the catch member allows the easy stepwise opening of the dental lamp socket terminal that avoids the need to coordinate three movements simultaneously. It also assists in counteracting the force of the springs that are loaded in the socket base members, which can be relatively high and thus difficult to manipulate solely by hand. This arrangement facilitates the operator's use of a lamp bulb holder device that avoids direct manual contact of the bulb by the operator.

In another embodiment, the manually operated actuators are levers that pivot about axes on the base of the socket terminal housing. Also, according to this specific embodiment, the catch member relates to an pawl pivotably mounted to the socket terminal housing. When the first manually operated actuator (lever) moves the first socket terminal into its retracted position, the catch member (pawl) pivots to engage the lever so as to hold the lever, and in turn, the socket terminal in the retracted position.

DETAILED DESCRIPTION

Figure 1:
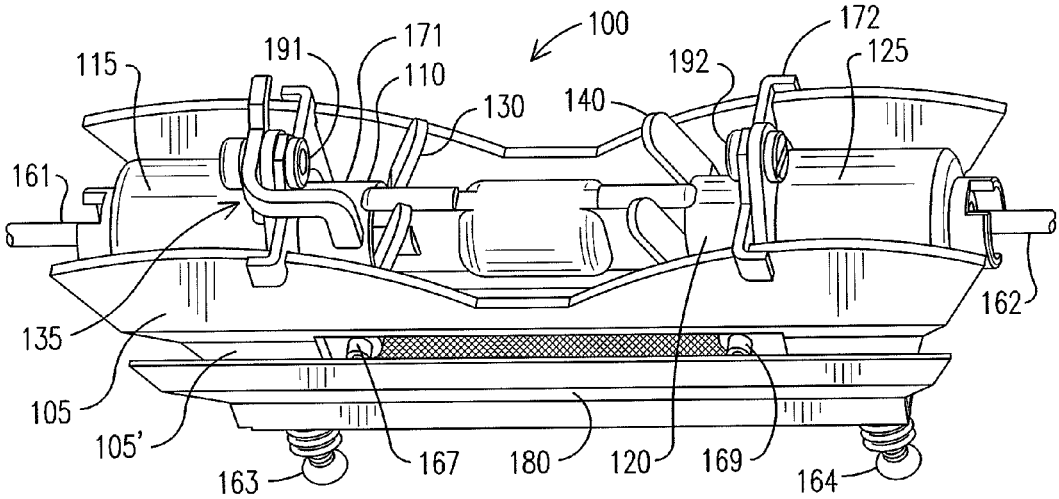
FIG. 1 shows a top, perspective view of a dental lamp socket assembly.

Turning to the drawings, FIG. 1 shows a top perspective view of a dental lamp socket assembly embodiment 100, that includes a housing 105 onto which a first and second socket terminal 110, 120 and corresponding socket base members 115, 125 are secured. First and second levers 130, 140 (constituting manually operated actuators) are secured to the lower portion of the housing 105' via pivot pins 167, 169. The first and second socket terminals 110, 120 movably mounted on socket base member 115, 125, which are spring loaded to urge the socket terminals 110, 120 to extend out of the corresponding base member toward extended positions. Connectors 161, 162 for supplying electrical power to the lamp bulb is provided at opposing ends of the of the socket assembly 100. First and second mounting screws 163, 164 associated with the lower portion of the housing 105' attach the socket assembly 100 to a dental lamp frame (shown generally in FIG. 4). Shield 180 is shown associated with the lower housing portion 105'. A pawl 135 is pivotably associated with a cross-frame member 171 of the housing 105 via pivot pin 191. Socket base member 115 is also associated with the cross-frame member 171 at pivot pin 191. Socket base member 125 is associated with cross-frame member 172 via connection 192.

Figure 2:
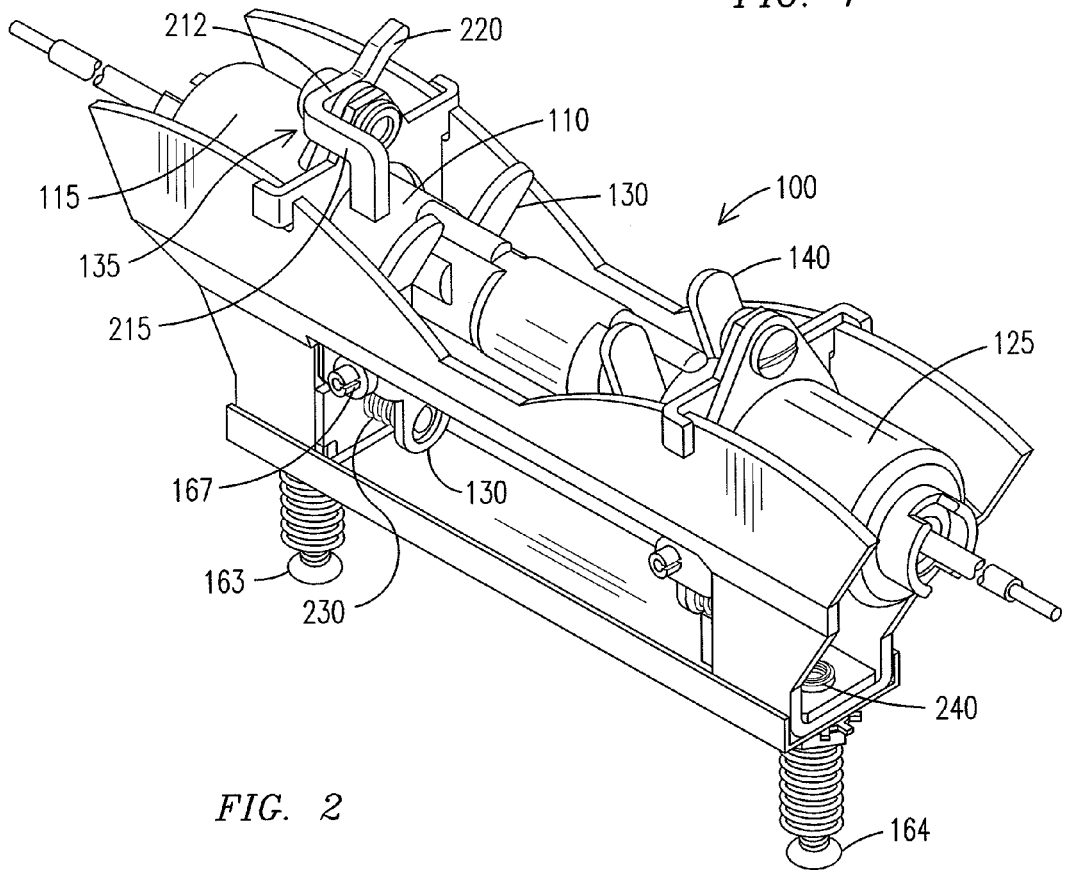
FIG. 2 shows a side, perspective view of the dental lamp socket assembly shown in FIG. 1.

FIG. 2 shows a side, perspective view of the dental lamp socket assembly 100 with shield 180 removed. FIG. 2 shows more clearly how the pawl 135 is pivotably associated to engage the first lever 130. The pawl 135 includes a pawl base 212, a pawl arm member 215, and a tab member 220. Depressing the tab 220 causes the pawl arm member 215 to pivot into the desired location for engaging the lever 130. Also, shown is the pivot pin 167 that pivotably associates the lever 130 to the housing 105. A spring 230 maintains contact of the lever 130 with the first socket terminal 110. Also shown in FIG. 2 is a hole 240 defined in the housing 105' where screw 164 engages the housing 105'.

Figure 3A:
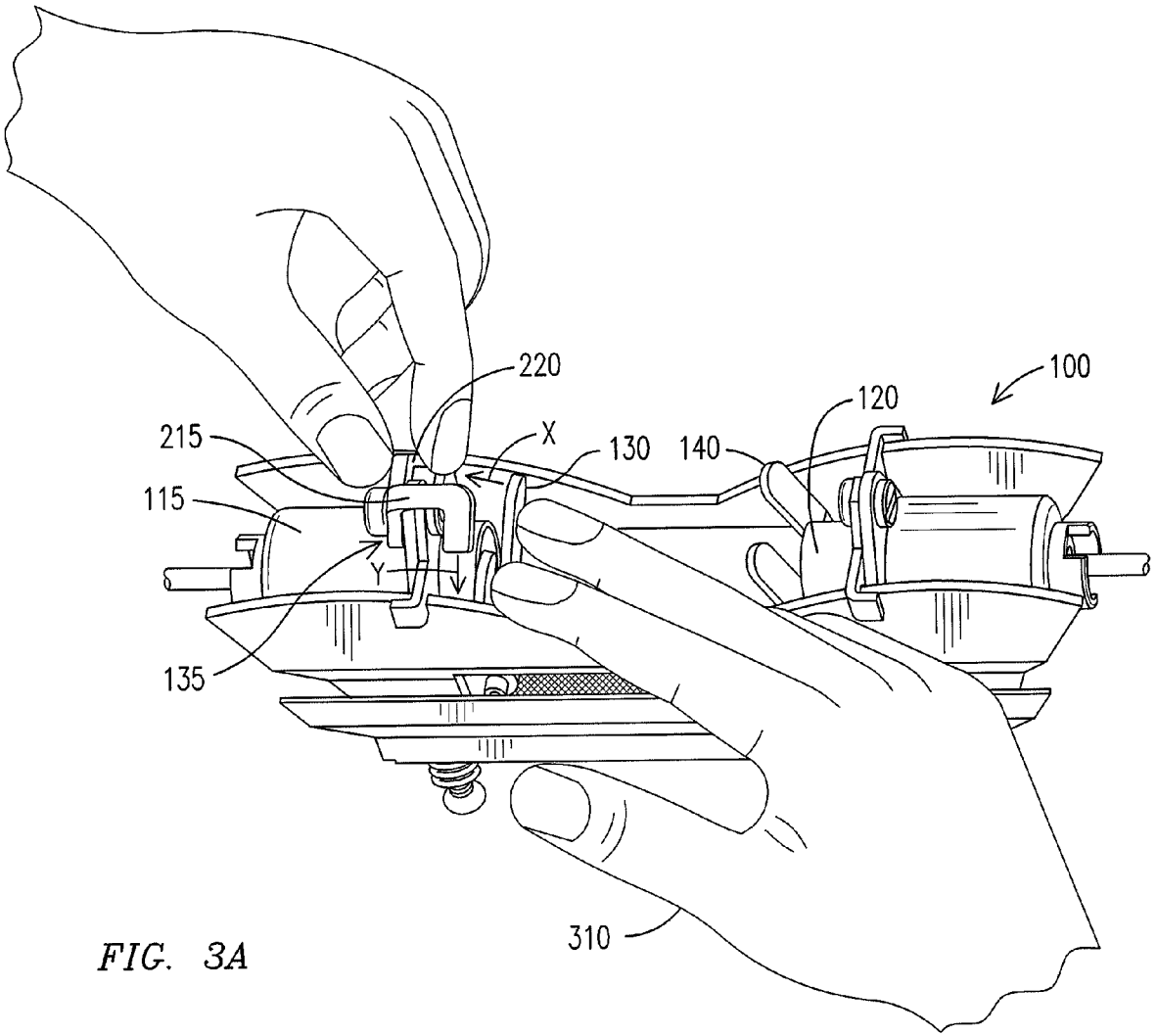
FIG. 3*a-c* are stepwise views of a dental lamp socket assembly in which a bulb is being replaced.
Figure 3B:
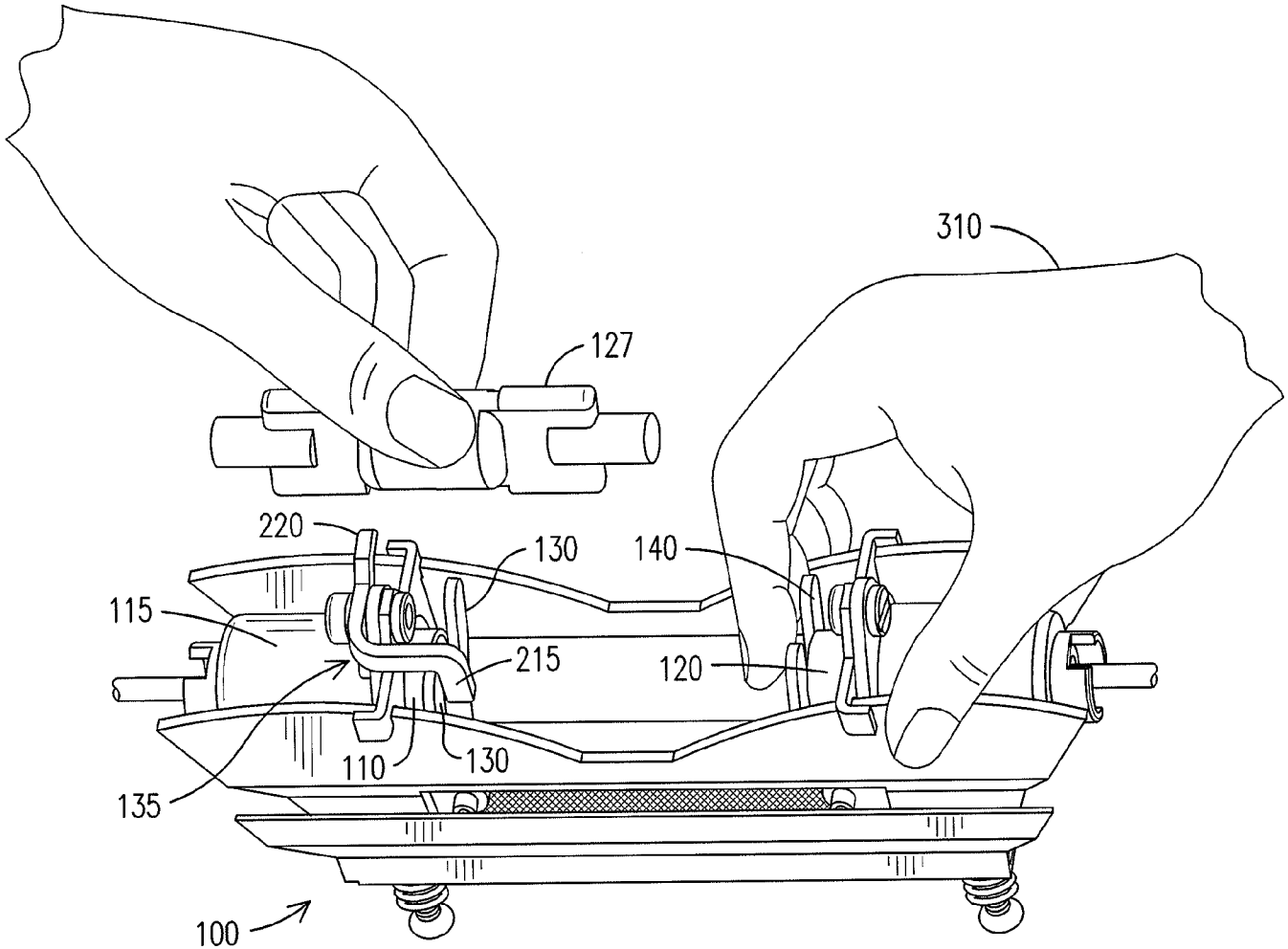
Figure 3C:
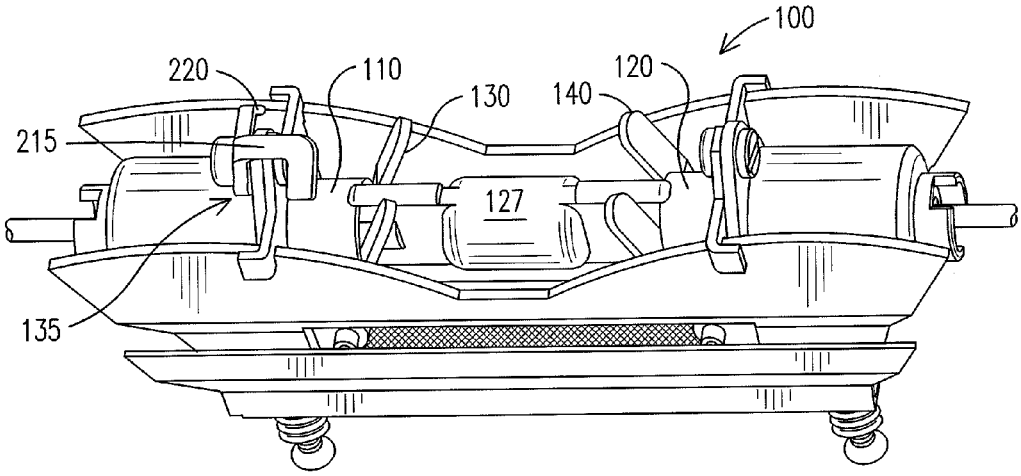

During placement of bulb as shown in FIG. 3*a-c*, the operator depresses the first lever 130, which in turn pushes back socket terminal 110. FIG. 3*a* shows the direction the operator's hand 310 depresses the lever 130 (see arrow x), and the intended direction of the pawl (see arrow y) once the lever is in the proper place. As shown in FIG. 3*b*, once the lever 130 has moved back a sufficient distance, the pawl 135 has been pivoted such that the pawl arm member 215 holds the lever 130, and in turn, the socket terminal 110 in a retracted position. With the socket terminal 110 held retracted, this frees both hands of the operator to depress the second lever 140 with one hand and manipulate the bulb 127 with the other hand, including via the use of a bulb holder device. Depressing the lever 140 causes the second socket terminal 120 to retract which then creates space for easy placement of the bulb 127. As shown in FIG. 3*c*, once the bulb 127 is in place, the socket terminal 120 is allowed to return to its extended position by releasing force on the second lever 140. Moreover, the pawl 135 is pivoted back thereby releasing lever 130, and the first socket terminal 110 is allowed to move back toward its extended position, whereby both first and second socket terminals 110, 120 completely engage and hold the bulb 127 in spring biased contact at both opposing ends to provide electrical power.

Figure 4:
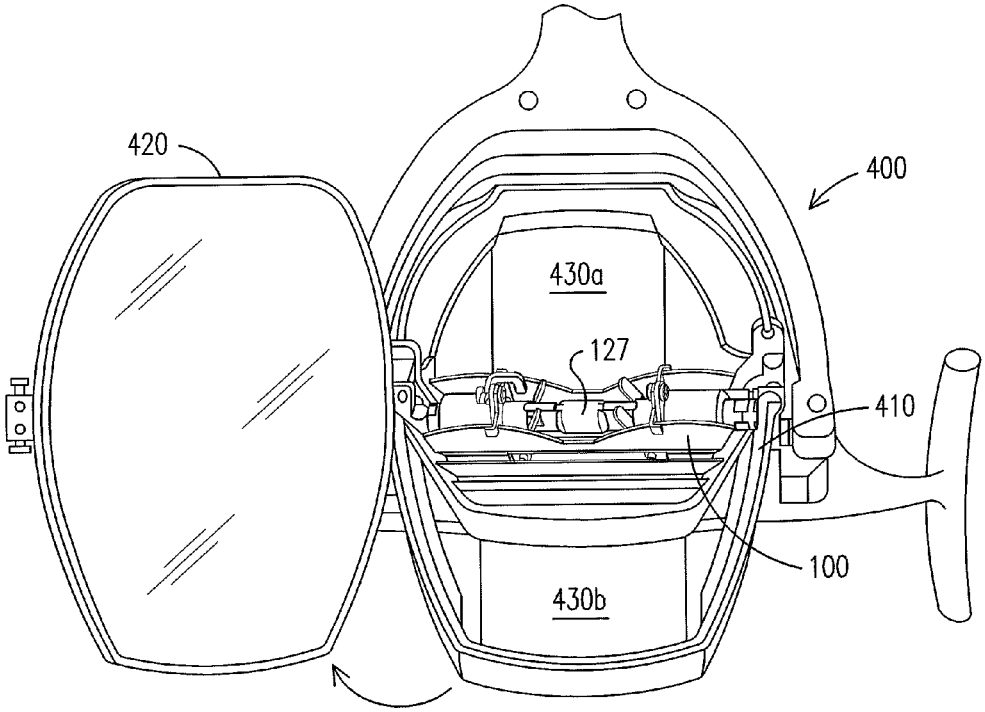
FIG. 4 shows the dental lamp socket assembly mounted to a dental lamp frame.

FIG. 4 shows a rear side of a dental lamp 400 having a dental lamp frame 410. A dental lamp socket assembly 100, as described and shown in FIG. 1 is shown attached to the dental lamp frame 410. The dental lamp 400 also includes a reflector 420 that is pivotably engaged to the dental light frame 410, that is shown swung open to allow access to the assembly 100. Upon placement or replacement of the lamp bulb 127, the reflector will be closed to allow normal operation of the dental lamp 400. The bulb generates and directs light toward the reflector which will be reflected toward a shield 430*a-b*, wherein light passes through the shield 430*a-b* and toward an intended dental work area.

It should be borne in mind that the housing can take a variety of shapes and configurations, and can incorporate multiple components. In typical embodiments of the present invention, the housing serves as a framework for securing the spring-loaded first and second socket terminals at an appropriate distance and location so as to receive a lamp bulb.

Although the foregoing description contains many specifics, these are not to be construed as limiting the scope of the present inventions, but merely as providing certain representative embodiments. Similarly, other embodiments of the inventions can be devised which do not depart from the spirit or scope of the present inventions. The scope of the inventions is, therefore, indicated and limited only by the respective appended claims and their legal equivalents, rather than by the foregoing description. All additions, deletions, and modifications to the inventions, as disclosed herein, which fall within the meaning and scope of the claims, are encompassed by the present inventions. The disclosures of any references cited herein are incorporated in their entirety to the extent not inconsistent with the teachings herein.

What is claimed is:

1. A dental lamp socket assembly adapted to be mounted to a dental lamp frame, said dental lamp socket assembly comprising:

a housing;

a first socket terminal and a second socket terminal movably mounted on said housing for movement between a retracted position enabling removal of any existing bulb and installation of a replacement bulb, and an extended position for engaging the bulb, wherein the first and second socket terminals are retractable relative to each other;

a first manually operated actuator and a second manually operated actuator associated with said first and second socket terminals, respectively, such that force applied to said first and second manually operated actuators retracts said first and second socket terminals, respectively; and a first catch member securely associated with said housing and configured to catch and hold said first socket terminal in its retracted position.

2. The dental lamp socket assembly of claim 1, further comprising first and second socket base members associated with said first and second socket terminals, respectively, such that the first and second socket terminals are movable relative to said first and second socket base members, respectively, between the extended position and the retracted position.

3. The dental lamp socket assembly of claim 2, wherein the first and second socket terminals are movably mounted relative to said first and second socket base members, respectively, the first and second socket terminals being resiliently biased relative to the first and second socket base members so as to urge said first and second socket terminals toward their respective extended positions.

4. The dental lamp socket assembly of claim 1, wherein said first and second manually operated actuators are levers that are mounted for pivotal movement relative to the housing.

5. The dental lamp socket assembly of claim 4, wherein said first catch member is a pawl mounted for pivotal movement relative to the housing.

6. The dental lamp socket assembly of claim 5 wherein said pawl comprises an pawl base, an arm member extending from said base, and a tab member extending from said base, wherein the base is mounted for pivotal movement relative the housing, and said arm member engages said lever upon depressing said tab member.

7. The dental lamp socket assembly of claim 1 further comprises a fastener for detachably securing the dental socket assembly to the dental lamp frame.

8. The dental lamp socket assembly of claim 2, wherein the first and second socket base members are electrically connected to electric connectors for providing electrical power to first and second socket terminals.

9. A dental lamp comprising a dental frame, a reflector pivotably associated with said dental frame and a dental lamp socket assembly engaged to said dental frame, said dental lamp socket assembly comprising:

a housing;

a first socket terminal and a second socket terminal securely associated with said housing, wherein the first and second socket terminals are retractable relative to each other;

a first manually operated actuator and a second manually operated actuator associated with said first and second socket terminals, respectively, such that force applied to said first and second manually operated actuators retracts said first and second socket terminals, respectively; and a first catch member securely associated with said housing and configured to catch and hold said first socket terminal in a retracted position.

10. The dental lamp of claim 9, further comprising first and second socket base members associated with said first and second socket terminals, respectively, such that the first and second socket terminals are slidable relative to said first and second socket base members, respectively, from an extended position to the retracted position.

11. The dental lamp of claim 10, wherein the first and second socket terminals slidably insert into said first and second socket base members, respectively, the first and second socket terminals and first and second socket base members comprising a spring-loaded interaction so as to urge said first and second socket terminals toward the extended position.

* * * * *